US005553327A

United States Patent [19]

Koecher et al.

[11] Patent Number: 5,553,327

[45] Date of Patent: Sep. 10, 1996

[54] HAT MADE FROM CARDBOARD BEVERAGE CONTAINER AND METHOD OF MAKING THE SAME

[75] Inventors: Anthony R. Koecher, 8500 170th St. N., Hugo, Minn. 55038; Kevin M. Schoeller, Hugo, Minn.

[73] Assignee: Anthony R. Koecher, Hugo, Minn.

[21] Appl. No.: 319,118

[22] Filed: Oct. 6, 1994

[51] Int. Cl.[6] ..... A42C 1/00

[52] U.S. Cl. ..... 2/200.3; 2/175.1; 2/175.2

[58] Field of Search ..... 2/171, 175.1, 200.3, 2/175.2, 175.9, 195.1, 200.1

[56] References Cited

U.S. PATENT DOCUMENTS

| | | | |
|---|---|---|---|
| 1,250,968 | 12/1917 | Claussen | 2/200.3 |
| 1,418,198 | 5/1922 | Neppell | 2/200.3 |
| 4,429,420 | 2/1984 | Wolff | 2/200.3 |
| 4,729,132 | 3/1988 | Fierro | 2/171.2 |
| 4,837,865 | 6/1989 | Roth | 2/12 |
| 5,094,343 | 3/1992 | Brown et al. | 206/216 |

*Primary Examiner*—Diana Biefeld

*Attorney, Agent, or Firm*—Merchant, Gould, Smith, Edell, Welter & Schmidt, P.A.

[57] ABSTRACT

A hat is constructed from a cardboard product container, for example a 24-pack beer package including a product logo and other graphics thereon. The hat provides a new use for a previously wasted container material, and enables fans or collectors to display their loyalty and support of a particular brand.

16 Claims, 2 Drawing Sheets

FIG.2
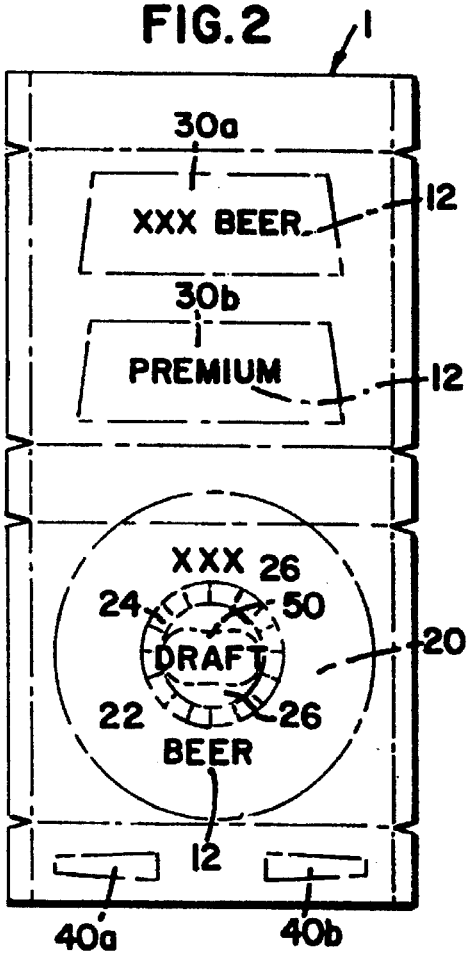
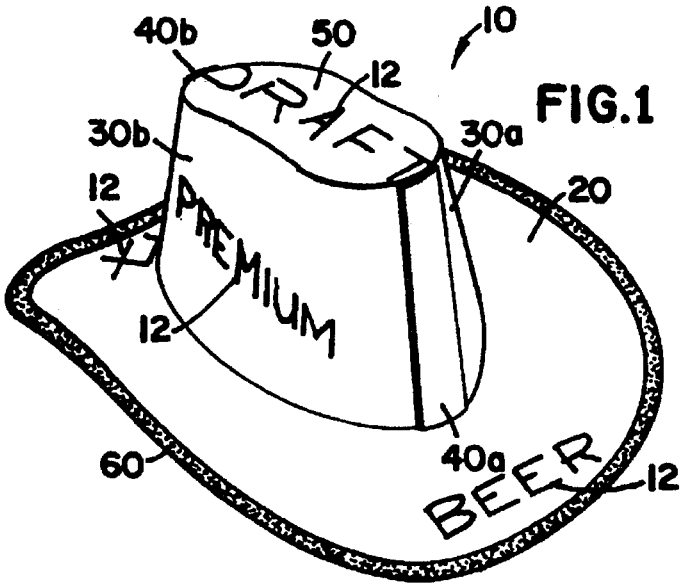
FIG.1
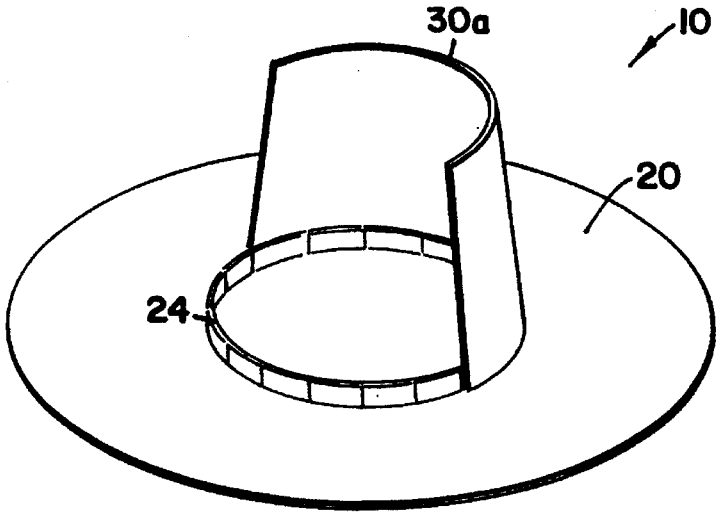
FIG.3

HAT MADE FROM CARDBOARD BEVERAGE CONTAINER AND METHOD OF MAKING THE SAME

FIELD OF THE INVENTION

The invention is directed to a hat and method of making the same, and more particularly, is directed to a hat which is made from a cardboard product container material such as the type used for packaging canned beverages.

BACKGROUND OF THE INVENTION

Beverages such as beer and soda are commonly sold in multiple packs of aluminum cans. For instance, packages, or cases, of 12 or 24 12-oz. cans are common.

Many of the multi-pack containers are formed from cardboard and include a product logo and other graphics. While these cardboard containers may be recycled, they are often thrown away, resulting in waste.

Many people also like to collect different items containing the product logos of different beverage brands. Further, many "fans" of a particular beverage may wish to display these items to show their support or loyalty for a particular brand of beverage.

It is therefore desirable to develop a new use for cardboard product containers containing product graphics which reduces the waste of these containers and which enables fans and collectors to proudly display their favorite beverage brands.

SUMMARY OF THE INVENTION

The invention addresses various needs in the art by providing a hat such as a stetson-type hat constructed from a cardboard product material such as used in discarded beverage containers. As such, a new use for a previously wasted material is provided. Further, fans or collectors of beverage brands have a new way of proudly displaying their brand loyalty.

Therefore, in accordance with one aspect of the invention, a method of making a hat is provided, which includes the steps of cutting a plurality of hat elements from cardboard product container material including a graphics disposed on an exterior surface thereof, and assembling the hat elements to form a hat, wherein the graphics on the exterior surface of the container material are disposed on visible exterior surfaces of the hat.

In accordance with another aspect of the invention, a hat is provided, including a brim with a head receiving aperture, a side wall circumscribing the aperture and affixed to the brim, and a top member affixed proximate a top edge of the side wall. The brim, the side wall and the top member are constructed from cardboard product container material including graphics printed on an exterior surface thereof, and the hat is constructed such that the graphics on the exterior surface of the container material are disposed on visible exterior surfaces of the hat.

These and other advantages and features, which characterize the invention, are described with particularity in the claims annexed hereto and forming a further part hereof. However, for a better understanding of the invention, and the advantages and objectives attained by its use, reference is made to the Drawing, and to the following descriptive matter, in which there is described a preferred embodiment of the invention.

BRIEF DESCRIPTION OF THE DRAWING

FIG. 1 is a perspective view of a preferred hat consistent with the principles of the invention;

FIG. 2 is a top plan view of an unassembled cardboard beverage container, showing cut-out patterns suitable for constructing the hat of FIG. 1; and FIGS. 3–5 are perspective views showing various steps in the construction of the hat of FIG. 1. FIG. 3 shows the mounting of a first side member to the brim of the hat, FIG. 4 shows the mounting of a second side member to the brim of the hat, and FIG. 5 shows the joining of the side edges of the first and second side members through the use of first and second connecting members.

DETAILED DESCRIPTION OF PREFERRED EMBODIMENTS

Figure 4:
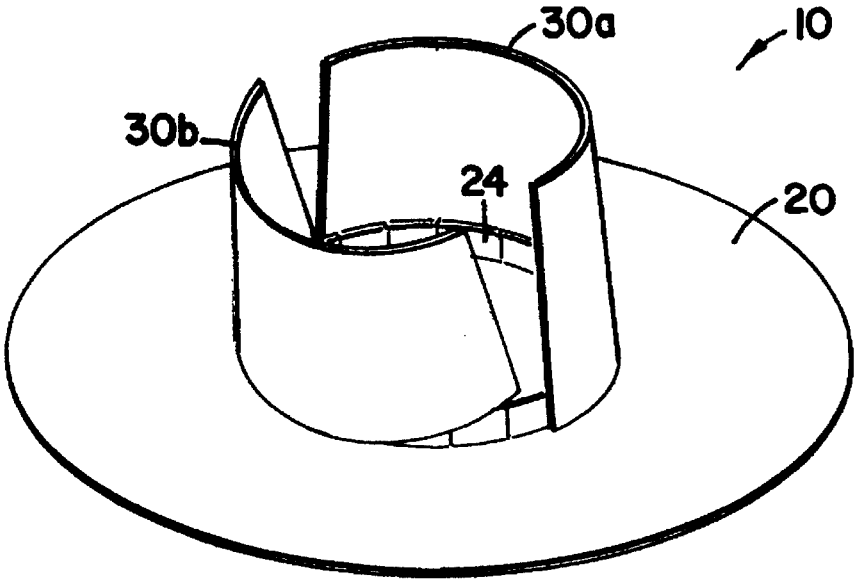

Turning to the Drawing, wherein like parts are denoted by like numbers throughout the several views, FIG. 1 shows a hat 10 constructed consistent with the principles of the invention. Hat 10 includes a brim 20, a side wall formed of first and second side members 30*a* and 30*b* joined by first and second connecting members 40*a* and 40*b*, and a top member 50. The underside and interior of hat 10 also includes a felt liner 60.

Hat 10 is preferably a stetson-type hat. However, it will be appreciated that other styles of hats may be constructed consistent with the invention. For example, styles such as fedoras, baseball caps, sailors caps, etc. may also be constructed by using suitable patterns.

As shown in FIG. 2, hat 10 is preferably constructed from cardboard beverage container material 1, such as the material from a single 24-pack cardboard beer container. Other sizes, types and numbers of containers, as well as containers for other products such as soda or other consumer products, may also be used for material 1. Preferably, the material includes graphics such as product logos (labeled 12) which give hat 10 an aesthetically pleasing appearance on visible exterior surfaces thereof.

To construct hat 10, the container material 1 should be broken down or disassembled (i.e., the adhesive joints formed between overlapping flaps on the container should be pulled apart) so that the container forms a single sheet. Then, several hat elements are cut from the material, preferably using preformed templates as guides.

FIG. 2 shows one arrangement of hat elements which may be cut from a single 24-pack (case) beverage container. It will be appreciated, however, that different arrangements of elements may be cut from one or more product containers. For example, it may be desirable to arrange different elements to obtain a desirable placement of graphics 12 thereon for the particular container used.

Once the hat elements, including brim 20, first and second side members 30*a* and 30*b*, first and second connecting members 40*a* and 40*b*, and top member 50, have been cut from material 1, the members are assembled together, preferably through the use of a hot melt adhesive using a glue gun. Other fastening means, such as staples, tacks, and other adhesives, may also be used.

The first step in the preferred method of assembling the hat is to mount first and second side members 30*a* and 30*b* to brim 20, as shown in FIGS. 3 and 4. Prior to mounting these members onto the brim, however, the head receiving aperture in the brim is preferably sized and a plurality of tabs 24 are formed and the walls thereof to assist in mounting the side members to the brim.

Returning to FIG. 2, the tabs 24 are formed by first cutting a first aperture 26 in the center of brim 20, then forming a plurality of cuts extending generally perpendicular to the wall of aperture 26. The cuts extend inward from the aperture wall to the point designated 22, which is the desired aperture size for the final hat. The size of aperture 22 will vary depending upon the particular size of hat desired.

Once the tabs 24 are formed in brim 20, they are then bent upward generally perpendicular to the plane of brim 20. Next, as shown in FIG. 3, the first side member 30*a* is joined to brim 20 using a bead of hot melt glue interposed between the bottom of interior surface of the side member and the exterior surfaces of tabs 24. As shown in FIG. 4, second side member 30*b* is affixed to brim 20 in the same manner as member 30*a*.

Figure 5:
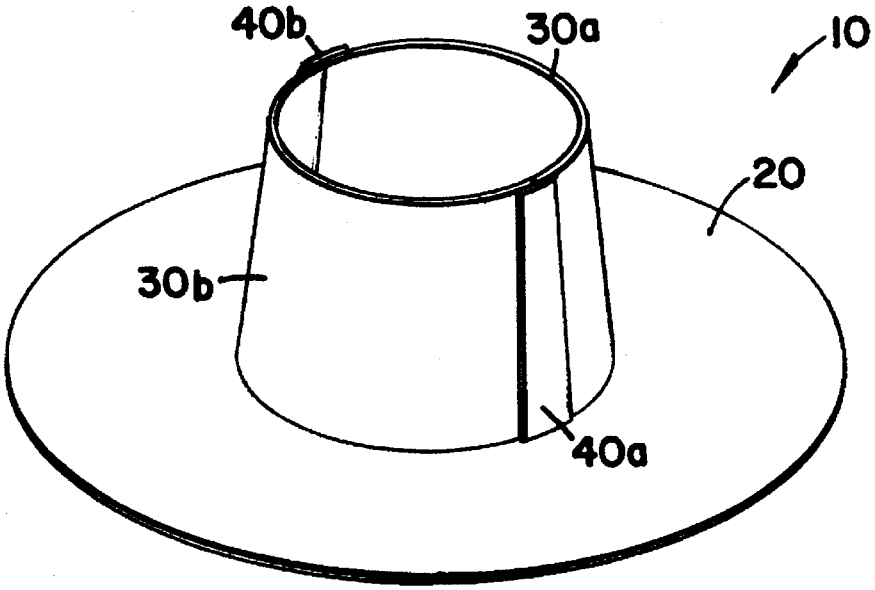

Next, as shown in FIG. 5, the opposing side edges of first and second side members 30*a* and 30*b* are pushed together to form a junction, and first and second connecting members 40*a* and 40*b* are connected in an overlapping fashion over the junction formed between the side edges of the side members to secure members 30*a* and 30*b* together. A bead of hot melt glue is interposed between the connecting members and the outer surfaces of the side members to secure the connecting members in place.

Returning to FIG. 1, the next step in the construction of hat 10 is to attach top member 50 along the top edge of the side members 30*a* and 30*b*. Top member 50 is preferably secured along its edge by a bead of glue disposed along an inner surface of the side members. Top member 50 is also preferably kidney shaped to give side members 30*a* and 30*b* an aesthetically pleasing profile. However, it will be appreciated that various shapes, including oval and circular, may be used for top member 50. It will also be appreciated that either top member 50 or side members 30*a* and 30*b* may include tabs similar to tabs 24 on brim 20 to facilitate the inner connection therebetween.

It may also be desirable to include a liner on hat 10, such as felt liner 60 as shown in FIG. 1. The liner is preferably bonded to the underside of brim 20 and to the interior surfaces of side members 30*a* and 30*b* and top member 50 using a hot melt adhesive. Edges of the felt liner 60 may also wrap over the outside edge of brim 20 and terminate on the top side thereof. It will be appreciated that the patterns of felt pieces required to cover the underside and interior surfaces of hat 10 will vary depending upon the particular patterns used for the hat elements in the hat.

As a finishing touch, it may also be desirable to selectively bend portions of brim 20 to sculpt or shape the hat. For example, for a stetson-style hat, it is desirable to bend the side edges of the brim upward, while bending the front and bottom edges downward. For other styles of hats, the degree of bending required will vary.

Several modifications may be made to the preferred embodiments. For example, the side walls of the hat may be formed of one single side member, as opposed to first and second side members 30*a* and 30*b*. Moreover, different contours may be provided for top member 50, or top member 50 may be omitted altogether. In addition, brim 20 may take any number of designs depending upon the type of hat, and may also be omitted. Also, reinforcing layers of cardboard material may be used in the different hat elements to strengthen the hat. For example, for non-corrugated cardboard, two or more layers of cardboard material may be used for the hat elements. The separate layers may even include opposing graphics, whereby the felt may be eliminated.

Other changes may be made to the preferred embodiments within the spirit and scope of the invention. Therefore, it will be appreciated that the invention lies wholly within the claims hereafter appended.

We claim:

1. A method of making a hat, comprising the steps of:

(a) cutting a plurality of hat elements from cardboard product container material including graphics disposed on an exterior surface thereof, wherein the cutting step comprises the steps of:

(1) cutting a brim, first and second side members, first and second connecting members and a top member from the material according to predetermined patterns, wherein the side members include top, bottom, front and rear edges; and (2) forming an aperture in the brim; and (b) assembling the hat elements to form a hat, wherein the graphics printed on the exterior surface of the container material are disposed on visible exterior surfaces of the hat, and wherein the assembly step includes the steps of:

(1) joining bottom edges of the first and second side members to the brim such that the side members circumscribe the aperture in the brim;

(2) joining opposing front and rear edges of the first and second side members together by overlapping the front and rear edges with the first and second connecting members, respectively; and (3) joining the top member to the first and second side members proximate top edges thereof.

2. The method of claim 1, wherein the cardboard product container material is from a single cardboard beverage container, and wherein the method further comprises the step of disassembling the container to form a single sheet of material.

3. The method of claim 2, wherein the beverage container holds a case of beer cans.

4. The method of claim 1, further comprising the steps of forming a plurality of tabs along a wall of the aperture in the brim by cutting inward from the wall of the aperture at a plurality of points; and bending the tabs upward to orient the tabs generally orthogonal to the brim.

5. The method of claim 1, wherein the assembly step includes the step of using a hot melt adhesive to join the hat members to one another.

6. The method of claim 1, further comprising the step of mounting a felt liner to an underside of the brim and to an interior area defined by the side and top members.

7. The method of claim 1, further comprising the step of shaping the hat by selectively bending the brim.

8. The method of claim 1, wherein the hat is a stetson-style hat.

9. A method of making a hat, comprising the steps of:

(a) cutting a brim, a top member, first and second side members, and first and second connecting members from cardboard product container material including graphics disposed on an exterior surface thereof, the side members including top, bottom, front and rear edges;

(b) forming an aperture in the brim;

(c) joining bottom edges of the first and second side members to the brim such that the side members circumscribe the aperture in the brim;

(d) joining opposing front and rear edges of the first and second side members together by overlapping the front and rear edges with the first and second connecting members, respectively; and (e) joining the top member to the first and second side members proximate top edges thereof, wherein the graphics printed on the exterior surface of the container material are disposed on visible exterior surfaces of the hat.

10. The method of claim 9, wherein the cardboard product container material is from a single cardboard beverage container, and wherein the method further comprises the step of disassembling the container to form a single sheet of material.

11. The method of claim 10, wherein the beverage container holds a case of beer cans.

12. The method of claim 9, further comprising the steps of forming a plurality of tabs along a wall of the aperture in the brim by cutting inward from the wall of the aperture at a plurality of points; and bending the tabs upward to orient the tabs generally orthogonal to the brim.

13. The method of claim 9, wherein the brim, top member, first and second side members, and first and second connecting members are joined using a hot melt adhesive.

14. The method of claim 9, further comprising the step of mounting a felt liner to an underside of the brim and to an interior area defined by the side and top members.

15. The method of claim 9, further comprising the step of shaping the hat by selectively bending the brim.

16. The method of claim 9, wherein the hat is a stetson-style hat.

* * * * *